US007982399B2

(12) United States Patent
Eijsermans

(10) Patent No.: US 7,982,399 B2
(45) Date of Patent: Jul. 19, 2011

(54) HIGH-PRESSURE GAS DISCHARGE LAMP HAVING ELECTRODE RODS WITH CRACK-INITIATING MEANS

(75) Inventor: Joseph Franciscus Raymond Eijsermans, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 234 days.

(21) Appl. No.: 12/295,788

(22) PCT Filed: Mar. 28, 2007

(86) PCT No.: PCT/IB2007/051087

§ 371 (c)(1), (2), (4) Date: Oct. 2, 2008

(87) PCT Pub. No.: WO2007/113742

PCT Pub. Date: Oct. 11, 2007

(65) Prior Publication Data

US 2009/0243485 A1 Oct. 1, 2009

(30) Foreign Application Priority Data

Apr. 5, 2006 (EP) ..... 06112259

(51) Int. Cl.
*H01J 17/18* (2006.01)
*H01J 9/24* (2006.01)

(52) U.S. Cl. ..... 313/623; 445/24

(58) Field of Classification Search ..... 313/623–626, 313/43; 445/24
See application file for complete search history.

(56) References Cited

U.S. PATENT DOCUMENTS

| | | | | |
|---|---|---|---|---|
| 5,461,277 | A | 10/1995 | Van Gennip et al. | |
| 5,905,340 | A | 5/1999 | Karlotski et al. | |
| 5,936,350 | A | 8/1999 | Yoshida et al. | |
| 2001/0005117 | A1 | 6/2001 | Nishida et al. | |
| 2001/0030498 | A1 * | 10/2001 | Tsutatani et al. | 313/350 |
| 2002/0190654 | A1 * | 12/2002 | Kanzaki et al. | 313/623 |

FOREIGN PATENT DOCUMENTS

| | | | |
|---|---|---|---|
| DE | 102005013759 | A1 | 9/2006 |
| EP | 0416937 | A2 | 3/1991 |
| GB | 2351603 | A | 1/2001 |
| JP | 10106492 | A | 4/1998 |

* cited by examiner

*Primary Examiner* — Joseph L Williams
*Assistant Examiner* — Brenitra M Lee

(57) ABSTRACT

A high-pressure gas discharge lamp has a bulb of quartz glass and two electrode rods. One end of each electrode rod is connected to a molybdenum foil member embedded in the quartz glass material, while the other end of each electrode rod projects into the gas discharge space inside the bulb. A portion of the electrode rod is embedded in the quartz glass material of the bulb. The surface of said embedded portion of the electrode rod is provided with means dots, recesses and/or protrusions for initiating cracks at predetermined locations in the quartz glass material surrounding the electrode rod during manufacture of the lamp.

12 Claims, 1 Drawing Sheet

HIGH-PRESSURE GAS DISCHARGE LAMP HAVING ELECTRODE RODS WITH CRACK-INITIATING MEANS

The invention relates to a high-pressure gas discharge lamp having a bulb of quartz glass and two electrode rods, wherein one end of each electrode rod is connected to a respective molybdenum foil member embedded in the quartz glass material, while the other end of each electrode rod projects into the gas discharge space inside the bulb, a portion of the electrode rod being embedded in the quartz glass material of the bulb.

A lamp of this type is disclosed in GB-A-2351603. This publication describes a gas discharge lamp comprising a quartz glass bulb enclosing the discharge space of the lamp. The lamp is provided with two pinch-sealed portions, one at each end of the quartz glass bulb. The ends of two tungsten electrode rods project into the discharge space and a portion of each electrode rod is embedded in a pinch-sealed portion of the bulb in such manner that the two electrode rods are positioned coaxially with respect to each other. The other ends of the two electrode rods are connected to the ends of conductive molybdenum foil members for supplying electric current to the electrode rods, which molybdenum foil members are also embedded in the pinch-sealed portions of the quartz glass bulb of the lamp. The other ends of the molybdenum foil members are connected to lead wires which extend outside the quartz glass bulb of the lamp.

Such a lamp, for example, a high-pressure mercury discharge lamp, may have a gas pressure of up to about 200 b during normal operation, and may consume an electric power in the range of 50 W to 500 W, or even up to 1500 W. The two electrode rods can be positioned coaxially at both ends of the bulb, but they can also be positioned parallel to and at some distance from each other, while they are embedded in the same pinch-sealed portion of the quartz glass bulb of the lamp. The lamp may be an integral part of a unit comprising a lamp and a reflector.

In such lamps, there is a difference in thermal expansion between the material of the electrode rods and the quartz glass material of the bulb, which material surrounds a portion of the electrode rods in the pinch-sealed portion of the lamp bulb. Such a difference in thermal expansion causes high stress in the materials of the lamp when in use, in particular in the run-up phase, and the high stress may result in premature lamp failure due to cracking or explosion of the lamp bulb. Several measures are known to avoid cracks in the quartz glass as a result of said difference in thermal expansion, such as applying coils around the electrode rods, or foils wrapped around the electrode rods, etc. A disadvantage of these measures is the relatively high additional costs, and most of these measures require additional parts in the lamp.

Publication GB-A-2351603 proposes causing certain cracks in the quartz glass material of the bulb during manufacture of the lamp, whereby a so-called residual-compressive-stress layer is formed around, and adhered to, the electrode rod. Such a layer, also indicated as coating and hereinafter referred to as bead, surrounds a portion of the electrode rod and prevents further cracks in the radial direction in the quartz glass material. Such further cracks may extend to the outer surface of the quartz glass bulb, thereby terminating the proper functioning of the lamp.

However, the length of the bead must be kept within certain limits. As is described in GB-A-2351603, the length of the bead must be at least 30% of the length of the embedded portion of the electrode rod, measured from its connection with the molybdenum foil member. The lamp is manufactured at a relatively high temperature so as to create adhesion between the electrode rod and the surrounding quartz glass, which will result in cracks due to the difference in expansion, which cracks outline the bead around a part of said embedded portion of the electrode rod. After manufacture of the lamp, the length of the bead is measured, and the lamp is rejected if the length of the bead is too short. However, it has appeared that the length of the bead must not be too long. Particularly if the transverse dimension of the quartz glass material at the location where the electrode rod is embedded is relatively small, and/or if the electrode has a relatively large diameter, for example, more than 250 μm, the length of the bead must be substantially smaller than the length of the embedded portion of the electrode rod. Otherwise, the diameter of the bead would become too large, which may lead to radial cracks.

An additional advantage of the creation of the bead as described above is the absence of a space between the electrode rod and the quartz glass. Such a space will have a negative effect on the functioning of the lamp when the salt filling of the gas discharge space would move to such a space.

It is an object of the invention to provide a high-pressure gas discharge lamp having a bulb of quartz glass and two electrode rods, wherein a portion of the electrode rod is embedded in the quartz glass material of the bulb, and a bead having an appropriate length is created during manufacture of the lamp.

This object is achieved in that the surface of the embedded portion of the electrode rod has means for initiating cracks at predetermined locations in the quartz glass material surrounding the electrode rod during manufacture of the lamp. Practice has proved that, by making use of crack-initiating means, the bead around the electrode rod extends from the location where the electrode rod is connected to the molybdenum foil member to the location of the crack-initiating means. The bead thus has a predetermined length, resulting in an improved quality of the lamp.

In preferred embodiments, said means for initiating cracks comprise a number of recesses (e.g. dents or indentations) and/or protrusions distributed on the circumference of the electrode rod at a predetermined distance from the molybdenum foil member, and/or said crack-initiating means comprise one or more tangential grooves and/or ridges in the surface of the electrode rod at a predetermined distance from the molybdenum foil member, and/or said crack-initiating means comprise dots of additional material on the surface of the electrode rod at a predetermined distance from the molybdenum foil member. All of these means on the surface of the electrode rod (separately or in combination) have appeared to be effective for initiating small cracks in the quartz glass material near the electrode rod so as to form a bead having an appropriate length around the electrode rod. Such means can be created by laser beam operation, as is known in the art.

In another embodiment, said means for initiating cracks comprise a wire coil having a short length around the electrode rod at a predetermined distance from the molybdenum foil member. Such a wire coil having only one or two turns around the electrode rod is also an effective means for initiating cracks at a predetermined location.

In a preferred embodiment, said means for initiating cracks are positioned at a distance from the molybdenum foil member of less than 90%, preferably less than 80%, more preferably less than 70% of the length of said embedded portion of the electrode rod. Said length of the embedded portion of the electrode rod is the length between the location where the electrode rod is connected to the molybdenum foil member and the location where the electrode rod enters the gas discharge space of the bulb. Furthermore, said means for initiating cracks are preferably positioned at a distance from the molybdenum foil member of more than 20%, more preferably more than 30% of the length of said embedded portion of the electrode rod. An appropriate bead having predetermined dimensions can thus be created around the electrode rod.

The invention further relates to a method of manufacturing a high-pressure gas discharge lamp having a bulb of quartz glass and two electrode rods, wherein one end of each electrode rod is connected to a molybdenum foil member embedded in the quartz glass material, while the other end of each electrode rod projects into the gas discharge space inside the bulb, a portion of the electrode rod being embedded in the quartz glass material of the bulb, and wherein cracks are initiated in the quartz glass material of the bulb during manufacture of the lamp by crack-initiating means on the surface of the electrode rod at a predetermined distance from the molybdenum foil member.

The invention will now be further elucidated with reference to the drawing comprising three schematic Figures, wherein.

The Figures are diagrammatic representations, showing only parts that are relevant for elucidation of the invention.

Figure 1:
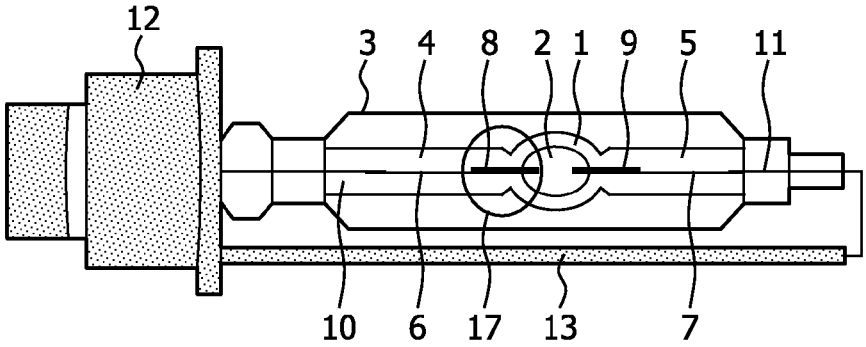
FIG. 1 shows the gas discharge lamp.

FIG. 1 shows a gas discharge lamp having a bulb 1 of quartz glass material. The bulb 1 accommodates a gas discharge space 2 filled with, for example, mercury, sodium iodide, scandium iodide, xenon and/or other gasses. The bulb 1 is surrounded by a transparent outer envelope 3.

The bulb 1 of the lamp is provided with two pinch-sealed portions 4,5 at opposite ends of the bulb 1. Each pinch-sealed portion 4,5 comprises a molybdenum foil member 6,7 embedded in the quartz glass material of the bulb 1. Each molybdenum foil member 6,7 is connected to the end of an electrode rod 8,9, while the other end of each electrode rod 8,9 projects into the gas discharge space 2. The electrode rods 8,9 are made of tungsten which may comprise an additive, e.g. $ThO_2$, at least on their surfaces.

The molybdenum foil members 6,7 are also connected to respective lead wires 10,11 which project outside the quartz glass material of the bulb 1, so that they can be connected to electric power supply means. Electric power is supplied to the electrode rods 8,9 through the molybdenum foil members 6,7.

The lamp is provided with a cap 12 for connecting the lamp to a lamp holder. The lamp cap 12 has contact elements (not shown) to be connected to corresponding contact members in the lamp holder, so that electric power can be supplied through these contact members from the lamp holder to the lamp. Lead wire 10 is connected to one of said contact elements and the other contact element is connected to an electric current-guiding rod 13 for supplying electric power to lead wire 11.

Figure 2:
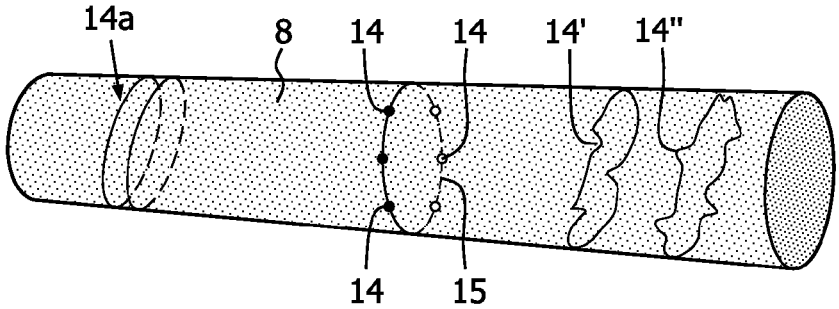
FIG. 2 shows the electrode rod of the lamp.

The circle 17 in FIG. 1 indicates one of the electrode rods 8,9, here electrode rod 8, which is diagrammatically represented in the perspective view of FIG. 2. The cylindrical outer surface of the electrode rod 8 is substantially smooth. The cylindrical outer surface is provided with a number of dots 14 of additional tungsten material, which dots 14 are located in a circle (dashed line 15) on the surface of the electrode rod 8. Instead of dots 14 of additional material, recesses or grooves 14', and/or protrusions or ridges 14" or other means may be made on or in the surface of the electrode rod, such as wire coil 14*a* having only one or two turns around the electrode rod.

Figure 3:
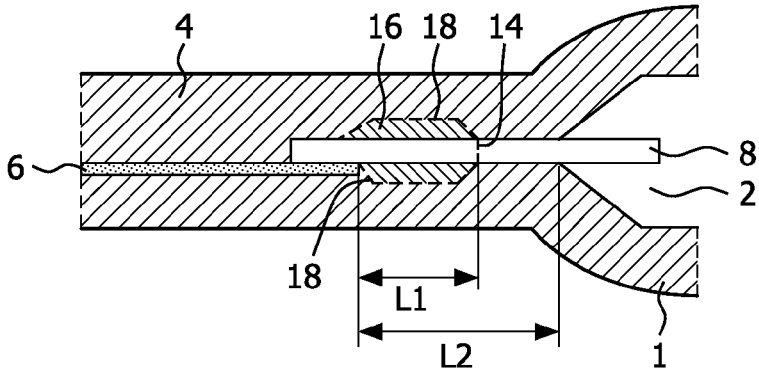
FIG. 3 is a sectional view of a part of the lamp.

FIG. 3 is a schematic sectional view of a part of the lamp, indicated by circle 17 in FIG. 1. Pinch-sealed portion 4 of the quartz glass material of the lamp bulb 1 comprises the molybdenum foil member 6 which is connected to the end of electrode rod 8. The other end of electrode rod 8 projects into the gas discharge space 2 of the lamp bulb 1.

In the case of a good adhesion between the quartz glass material and the tungsten electrode rod 8, there will be a high tensile stress in the materials after the lamp bulb 1 has been sealed and the materials have cooled down, which is due to the difference in coefficients of expansion of the material of the electrode rod and the quartz glass material. Such a stress will result in cracks in the quartz glass material during manufacture or use of the lamp. If certain temperatures are applied during the sealing operation, cracks in the quartz glass material will be created during manufacture of the lamp, as is described in GB-A-2351603.

In practice, such cracks 18 in the quartz glass material appear to form the boundary of the so-called bead 16 around a part of the electrode rod 8. The bead 16 is a piece of the quartz glass material that is separated by the cracks 18 from the remaining part of the quartz glass material, and it surrounds the electrode rod 8. The bead 16 prevents the quartz glass material from further (uncontrolled) cracking, e.g. radial cracks, during operation of the lamp.

Depending on the dimension of the pinch-sealed portions 4 and the diameter and length of the electrode rod 8, the bead 16 must have a predetermined dimension in order to obtain the desired improvement of the lamp. Particularly if the bead 16 is too long, its diameter may become too large, resulting in further cracking of the quartz glass material during operation of the lamp. It is therefore desirable to create a bead 16 having a predetermined length.

In practice, one end of the bead 16 is located near the connection between the molybdenum foil member 6 and the electrode rod 8. If the other end can be created at a predetermined location, the length of the bead 16 is thus defined. The electrode rod 8 is therefore provided with crack-initiating means 14 at said predetermined location of the electrode rod 8.

In FIG. 3, the length of the bead 16 is indicated by L1, and the portion of the electrode rod 8 that is embedded in the quartz glass material is indicated by L2. By locating the crack-initiating means at the predetermined position on the surface of the electrode rod 8, the length L1 of the bead 16 is a certain percentage of the length of the embedded portion L2 of the electrode rod 8. In this example of the lamp, the percentage is about 60%.

The embodiment of the lamp described above is only an example of a gas discharge lamp according to the invention; many other embodiments are possible.

The invention claimed is:

1. A high-pressure gas discharge lamp having a bulb of quartz glass and two electrode rods, wherein one end of each electrode rod is connected to a respective molybdenum foil member embedded in quartz glass material, while another end of each electrode rod projects into a gas discharge space inside the bulb, an embedded portion of the electrode rod being embedded in the quartz glass material of the bulb, wherein recesses are formed in a surface of said embedded portion of the electrode rod for initiating cracks at predetermined locations in the quartz glass material surrounding the electrode rod during manufacture of the high-pressure gas discharge lamp, and wherein dots of additional material are provided on the surface of the embedded portion of the electrode rod at a predetermined distance from the molybdenum foil member.

2. The high-pressure gas discharge lamp as claimed in claim 1, wherein the recesses are distributed on a circumference of the embedded portion of the electrode rod at a predetermined distance from the molybdenum foil member.

3. The high-pressure gas discharge lamp as claimed in claim 1, further comprising a number of protrusions distributed on a circumference of the embedded portion of the electrode rod at a predetermined distance from the molybdenum foil member.

4. The high-pressure gas discharge lamp as claimed in claim 1, wherein the recesses includes tangential grooves in the surface of the embedded portion of the electrode rod at a predetermined distance from the molybdenum foil member, and wherein tangential ridges are provided on the surface of the embedded portion of the electrode rod at the predetermined distance from the molybdenum foil member.

5. The high-pressure gas discharge lamp as claimed in claim 1, further comprising a wire coil having only one or two turns around the embedded portion of the electrode rod at a predetermined distance from the molybdenum foil member.

6. The high-pressure gas discharge lamp as claimed in claim 1, wherein the recesses are positioned at a distance from the molybdenum foil member of less than 90% of a length of said embedded portion of the electrode rod.

7. The high-pressure gas discharge lamp as claimed in claim 1, wherein the recesses are positioned at a distance from the molybdenum foil member of more than 20% of a length of said embedded portion of the electrode rod.

8. The high-pressure gas discharge lamp of claim 1, the recesses are positioned at a distance from the molybdenum foil member of less than 80% of a length of said embedded portion of the electrode rod.

9. The high-pressure gas discharge lamp of claim 1, wherein the recesses are positioned at a distance from the molybdenum foil member of less than 70% of a length of said embedded portion of the electrode rod.

10. The high-pressure gas discharge lamp of claim 1, wherein the recesses are positioned at a distance from the molybdenum foil member of more than 30% of a length of said embedded portion of the electrode rod.

11. A method of manufacturing a high-pressure gas discharge lamp having a bulb of quartz glass and two electrode rods, the method comprising the acts of:

connecting one end of each electrode rod to a molybdenum foil member embedded in the quartz glass material, while another end of each electrode rod projects into the gas discharge space inside the bulb, an embedded portion of the electrode rod being embedded in the quartz glass material of the bulb;

providing dots of additional material on a surface of the embedded portion of the electrode rod at a predetermined distance from the molybdenum foil member; and initiating cracks in the quartz glass material surrounding the electrode rod during manufacture of the lamp by recesses in the surface of the electrode rod at a predetermined distance from the molybdenum foil member.

12. The method of claim 11, further comprising the act of activating a laser to form the recesses.

* * * * *